US008234721B1

(12) United States Patent
Cestare et al.

(10) Patent No.: US 8,234,721 B1
(45) Date of Patent: Aug. 7, 2012

(54) HEADGEAR WITH INTEGRATED GAME NETTING

(76) Inventors: John Cestare, Lindenhurst, NY (US); Scott McManus, Lindenhurst, NY (US)

( * ) Notice: Subject to any disclaimer, the term of this patent is extended or adjusted under 35 U.S.C. 154(b) by 23 days.

(21) Appl. No.: 12/552,419

(22) Filed: Sep. 2, 2009

Related U.S. Application Data

(63) Continuation-in-part of application No. 11/491,688, filed on Jul. 24, 2006, now abandoned.

(51) Int. Cl.
*A42B 1/20* (2006.01)

(52) U.S. Cl. ..... 2/171.1; 2/209.11; 2/209.13

(58) Field of Classification Search ..... 2/171, 171.1, 2/171.4, 171.5, 195.1, 209.11, 209.12, 209.13, 2/209.3, 209.4, 209.5; 273/317.3, 402, 317, 273/317.1, DIG. 17; 473/479, 481, 485, 473/487

See application file for complete search history.

(56) References Cited

U.S. PATENT DOCUMENTS

| | | | | | |
|---|---|---|---|---|---|
| 48,510 | A | * | 7/1865 | Bracher | 2/200.1 |
| 857,820 | A | * | 6/1907 | Mosher | 248/99 |
| 1,105,400 | A | | 7/1914 | Burke | |
| 1,795,423 | A | * | 3/1931 | Bullard | 2/416 |
| 2,230,813 | A | * | 2/1941 | Pressman | 473/481 |
| 2,443,848 | A | * | 6/1948 | Boeringer | 2/209.11 |
| 2,473,908 | A | * | 6/1949 | Rubin | 473/487 |
| 2,512,417 | A | * | 6/1950 | Cook | 248/315 |
| 2,597,447 | A | | 5/1952 | Bruns | |
| 2,688,204 | A | * | 9/1954 | Laubhan | 43/12 |
| 4,815,734 | A | * | 3/1989 | Verhulst | 473/488 |
| 4,873,726 | A | * | 10/1989 | Tapia | 2/195.1 |
| 5,007,637 | A | * | 4/1991 | Foley | 473/487 |
| 5,070,545 | A | | 12/1991 | Tapia | |
| 5,118,059 | A | * | 6/1992 | Mainer | 248/215 |
| 5,157,788 | A | * | 10/1992 | Schultz | 2/7 |
| 5,222,259 | A | * | 6/1993 | Bristor | 2/115 |
| 5,224,699 | A | | 7/1993 | Zaruba | |
| 5,275,419 | A | * | 1/1994 | Kazemi | 273/402 |
| 5,301,450 | A | | 4/1994 | Boyd | |
| 5,367,713 | A | | 11/1994 | McCallum | |
| 5,437,062 | A | | 8/1995 | Douglas | |
| 5,481,759 | A | | 1/1996 | Rinaldi | |
| 5,630,230 | A | * | 5/1997 | Fujino et al. | 2/200.1 |
| 5,771,493 | A | * | 6/1998 | Proctor | 2/209.13 |
| 5,815,841 | A | * | 10/1998 | Spangrud | 2/195.1 |
| 5,845,338 | A | * | 12/1998 | Clark | 2/195.1 |
| 5,862,523 | A | * | 1/1999 | Proctor | 2/209.11 |
| 5,875,493 | A | * | 3/1999 | MacDonald et al. | 2/172 |
| 5,901,370 | A | * | 5/1999 | Linday | 2/10 |
| 5,933,871 | A | | 8/1999 | Kraft | |
| 6,070,270 | A | * | 6/2000 | De La Torre | 2/171.1 |

(Continued)

*Primary Examiner* — Khoa Huynh
*Assistant Examiner* — S. C. Cline
(74) *Attorney, Agent, or Firm* — Michael I. Kroll

(57) ABSTRACT

Headgear comprising a crown portion, a visor portion, and a netting secured to the visor portion. The crown portion is preferably separably secured to the visor portion. Various means of separably securing the crown portion to the visor portion are used including any of Velcro®, or other hook and loop fastening material, buttons, snaps, elastic, or the like. Various means of securing the netting to the visor portion are also used including any of Velcro® or other hook and loop fastening material, buttons, snaps, thread, or the like. The headgear may also omit the crown portion to provide only the visor portion with the netting secured thereto. In any case, a bill of the visor portion may be fitted between a door frame and an edge of the door and the frame, in order to render the netting available for tossing articles into the netting.

5 Claims, 11 Drawing Sheets

U.S. PATENT DOCUMENTS

| | | | | |
|---|---|---|---|---|
| 6,230,331 | B1 * | 5/2001 | Aguilar et al. | 2/209.11 |
| 6,385,776 | B2 | 5/2002 | Linday | |
| 6,557,180 | B2 | 5/2003 | Hall McKenzie | |
| 6,643,848 | B1 | 11/2003 | May | |
| 6,948,189 | B2 * | 9/2005 | Early | 2/184.5 |
| 7,611,146 | B2 * | 11/2009 | Arden | 273/317 |
| 2001/0034894 | A1 | 11/2001 | Godfrey et al. | |
| 2002/0074184 | A1 | 6/2002 | Cowgill et al. | |
| 2003/0233696 | A1 | 12/2003 | Lee | |
| 2004/0210983 | A1 * | 10/2004 | Early | 2/171 |
| 2008/0034474 | A1 | 2/2008 | Cestare | |

* cited by examiner

HEADGEAR WITH INTEGRATED GAME NETTING

CROSS REFERENCE TO RELATE APPLICATIONS

Related Applications

This application is a continuation-in-part of U.S. patent application Ser. No. 11/491,688, filed 24 Jul. 2006 now abandoned.

Please incorporate by reference all information in said patent application into this continuation-in-part application.

BACKGROUND OF THE INVENTION

1. Field of the Invention

The invention generally relates to headgear. More specifically, the invention relates to headgear having a game netting integrated therewith.

2. Description of the Prior Art

Headgear, in the form of hats, caps, and/or visors, has long been available publicly. Various styles of headgear exist to accommodate fashion and function requirements in a myriad of social venues. Such venues may include, for example, formal events, political rallies, church or religious events, sporting events, hunting, walking, beach going, or other such events. In any case, conventional headgear is typically adorned appropriately to suit the social venues to which the headgear is worn. Such adornments may comprise embroidered or printed designs, logos, or attachments to the headgear. The attachments may include, for example, pins, feathers, ribbons, flowers, patches, buttons, or the like, and may even include whimsical attachments such as the head and tail of a fish, or other theme-motivated attachments, for example.

U.S. Patent Application Publication No. 2001/0034894 to Godfrey, et al. shows a typical sports cap in which various logos may be interchangeably attached to the front face of the cap in order to suit the event one is attending while wearing the cap.

U.S. Pat. No. 5,437,062 to Douglas shows a baseball cap with a detachable visor. U.S. Pat. No. 5,481,759 to Rinaldi shows an expandable baseball cap configured to fit people having variously shaped and sized heads. The expandable baseball cap of Rinaldi also shows a detachable visor. U.S. Pat. No. 6,557,180 to Hall McKenzie shows a sports cap with a reversible crown and a detachable visor. U.S. Pat. No. 6,643,848 to May shows a cap having an optional visor, or bill, wherein the visor, or bill, detachable from the cap. Thus, it is known to have detachable visors, or bills, comprising a sports cap or other type of headgear.

Still other known headgear comprise functions other than mere coverage on one's head. For example, U.S. Pat. No. 5,367,713 to McCallum shows a sports cap that is convertible into a bag for storing or carrying goods. Further, U.S. Patent Application Publication No. 2002/0074184 to Cowgill, et al. shows a stocking-type hat that is convertible into a megaphone or hearing device for use at a sporting event, for example, or is convertible into a sack for storing and carrying goods, as another example.

None of the conventional headgear described above provide headgear having a game made integral therewith. In view of this, a niche exists for headgear that integrates a game therewith, whereby the headgear is easily converted from its function as headgear into the game that is integrated into the headgear.

SUMMARY OF THE INVENTION

The various embodiments described herein are directed to headgear comprising a crown portion and a visor portion, each having an integral circumferential band portion wherein at least one of which is a circumferentially adjustable band. The crown portion band may be separably secured to the visor band portion, and a netting is secured to the visor band portion. The circumferentially adjustable band may be provided on the visor band portion and may be comprised of portions having Velcro®, or other conventional fastener, provided thereon to enable adjustment of the circumferentially adjustable band of the visor portion to the size and shape of the one wearing the headgear. The circumferentially adjustable band may also be provided on the crown band portion and may also be comprised of portions having Velcro®, or other conventional fastener, but is preferably comprised of a continuous band of material, such as elastic, that merely gathers or releases to correspond to the size of the circumferential band portion of the visor portion, when the crown is secured to the visor portion.

In some embodiments, the crown portion is separably secured to the visor portion using Velcro®, or other hook and loop fastening material. The Velcro®, or other hook and loop fastening material, is preferably secured to an interior surface of the circumferential band of the crown and to a corresponding exterior surface of the circumferential band of the visor portion such that when the circumferential band of the crown portion is placed over the circumferential band of the visor portion, the corresponding portions of the Velcro®, or other hook and loop fastening material, align with one another and secure the crown portion to the visor portion. The Velcro®, or other hook and loop fastening material, may be attached in discrete locations on the interior surface of the circumferential band of the crown portion and to corresponding discrete locations of the exterior surface of the circumferential band of the visor portion. Alternatively, the Velcro®, or other hook and loop fastening material, may be attached as a continuous band over each of the interior surface of the circumferential band of the crown and the corresponding exterior surface of the circumferential band of the visor portion. Although perhaps not as attractive, a zipper or zippers could also be used in place of the Velcro®, or other hook and loop fastening material, to separably secure the crown portion to the visor portion of the headgear.

In other embodiments, the crown portion is separably secured to the visor portion using buttons arranged on one of the circumferential bands of the crown portion and the visor portion, and button receptacles stitched into the corresponding other of the circumferential bands of the crown portion and the visor portion and in alignment with the provided buttons.

In still other embodiments, the crown portion is separably secured to the visor portion using snaps and snap receptacles arranged in alignment with one another on the corresponding portions of the circumferential bands of the crown portion and the visor portion.

In practice, when the crown portion is secured to the visor portion, the adjustment of the circumferential band of the visor portion, for example, causes the corresponding adjustment of the circumferential band of the crown portion of the headgear, when the crown portion is secured thereto the visor portion. The netting or hoop remains secured to the visor portion, but is collected and situated within the crown portion of the headgear as the headgear is worn by a person. Further, when the crown portion of the headgear is removed from the visor portion, the netting or hoop secured to the visor portion extends, thereby providing the game hoop into which separately provided articles, such as a ball, may be thrown as in a basketball game. A bill of the visor portion of the headgear extends from the circumferential band of the visor portion and is configured to fit between a frame of a door and an edge of the door, for example, in order to secure the game hoop in place for playing therewith. Alternatively, the bill of the visor portion may be fitted between the frame of a drawer and an edge of the drawer to secure the game hoop in place for playing therewith.

Of course, the visor portion with the netting or hoop secured thereto represents yet another embodiment of the headgear described herein, wherein the crown portion of other embodiments is omitted. In such case, the Velcro®, buttons, snaps or other means of fastening the crown portion to the visor portion may also be omitted.

In the various embodiments described herein, the netting or hoop is preferably stitched directly to portions of the circumferential band of the visor portion. The netting or hoop may alternatively be secured to the circumferential band of the visor portion using buttons, snaps, Velcro® or other hook and loop fastening material, for example.

The above and other features of the invention, including various novel details of construction and combinations of parts, will now be more particularly described with reference to the accompanying drawings and claims. It will be understood that the various exemplary embodiments of the invention described herein are shown by way of illustration only and not as a limitation thereof. The principles and features of this invention may be employed in various alternative embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE INVENTION

Figure 1:
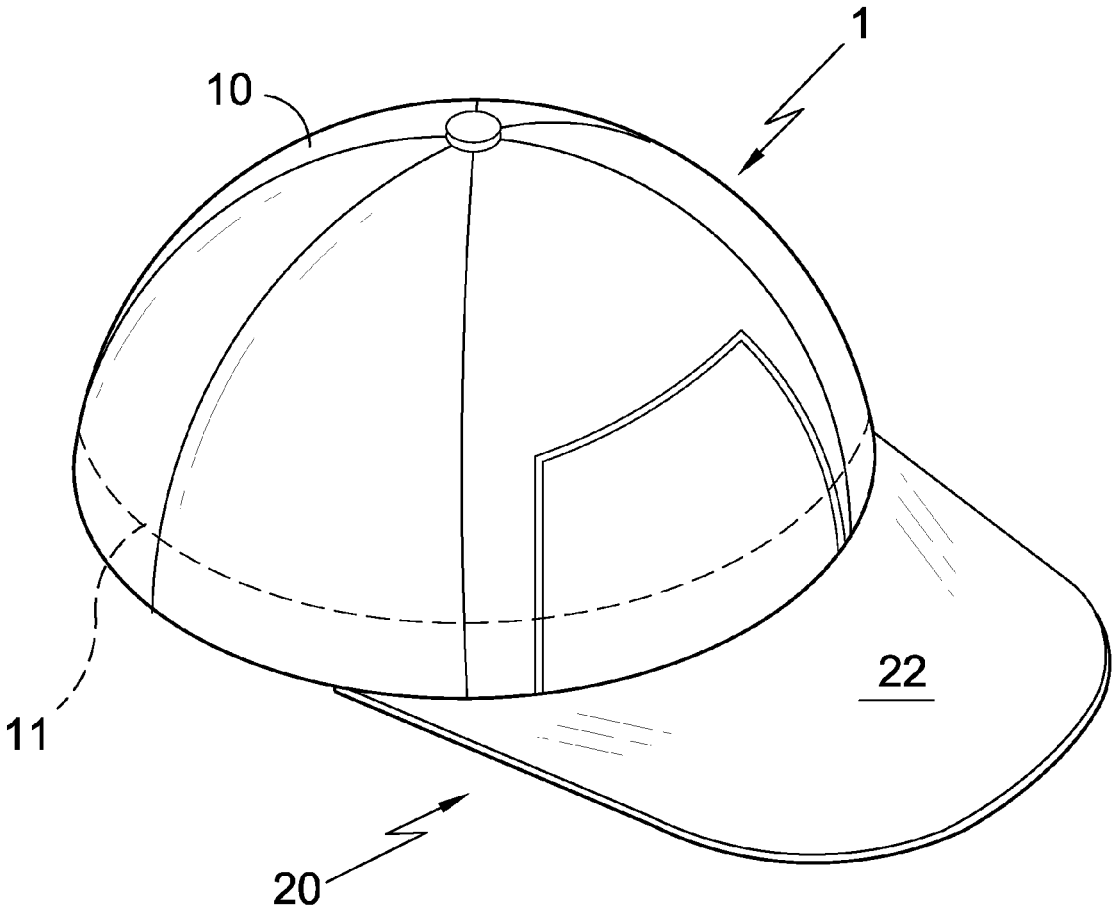
FIG. 1 illustrates a piece of headgear having representative components assembled according to various embodiments described herein.

FIG. 1 illustrates a piece of headgear 1 according to various embodiments described herein. In particular, FIG. 1 illustrates a crown portion 10 secured to a visor portion 20. The crown portion 10 further comprises a circumferential band 11 around the base of the crown portion 10. The circumferential band 11 may be circumferentially adjustable so as to gather and release according to the size of a circumferential band 21 of the visor portion 20 to which the circumferential band 11 is separably secured. The visor portion 20, shown in more detail in FIGS. 2*a*-2*c*, thus further comprises the circumferential band 21 that may also be circumferentially adjustable. The circumferential band 11 of the crown portion 10 is preferably comprised at least partly of an elastic material that gathers and releases to correspond to the size of the underlying circumferential band 21 of the visor portion to which the crown portion 10 is separably secured. Of course, Velcro® or other hook and loop fastening material, buttons, snaps, or other conventional fastening means, may be used to separably secure the circumferential band 11 of the crown portion 10 to the circumferential band 21 of the visor portion 20, as the artisan will readily appreciate.

Figure 2A:
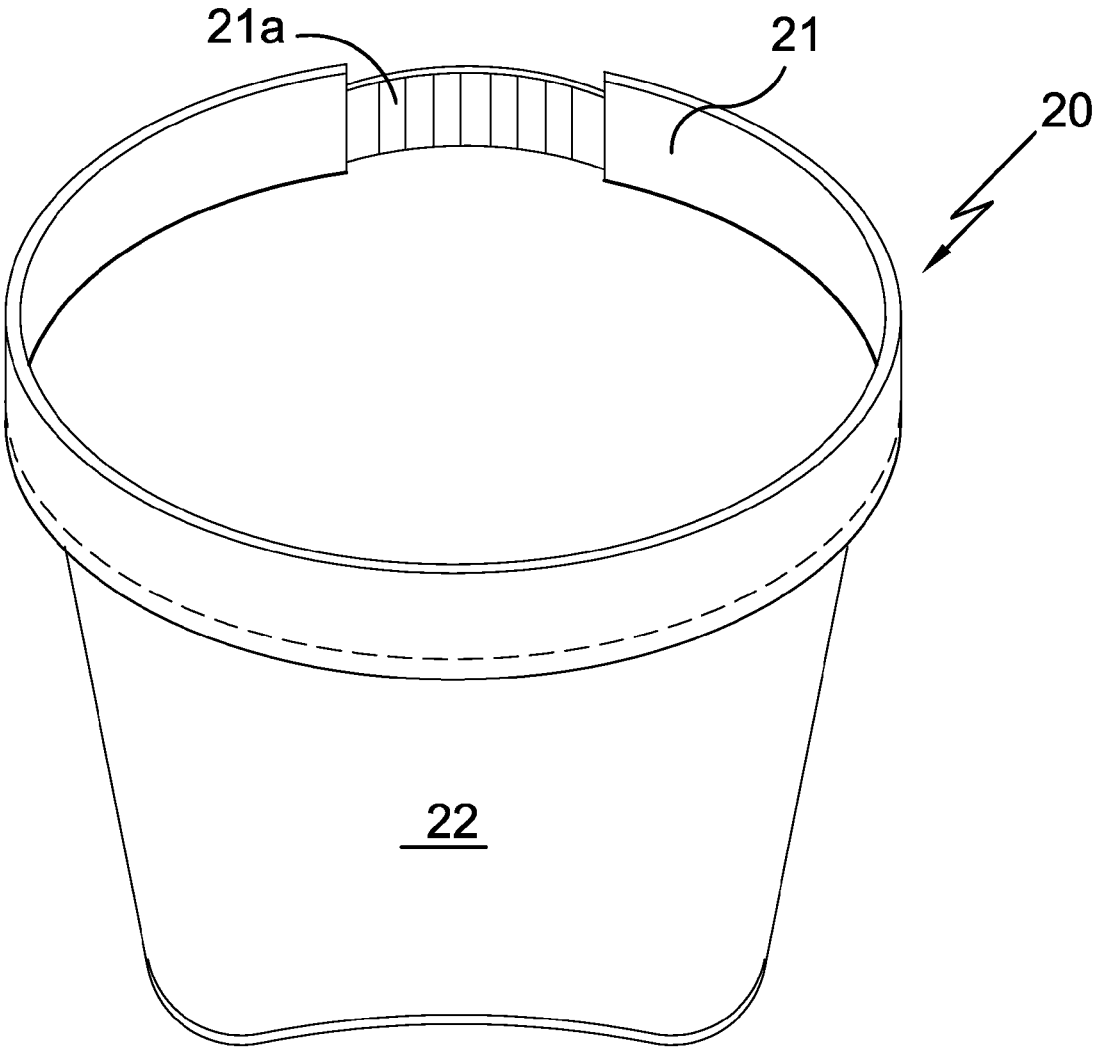
FIGS. 2*a*-2*c* illustrates aspects of a visor portion according to various embodiments described herein.

FIG. 2*a* illustrates a visor portion 20 according to various embodiments described herein. The visor portion 20 is generally comprised of the circumferential band 21, and a bill 22. The circumferential band 21 may be made circumferentially adjustable by comprising at least a portion of the band 21 with an elastic material 21*a*, as in FIG. 2*a*. Of course, the artisan will readily appreciate that the elastic material 21*a* may comprise more or less of the band 21, than as shown in FIG. 2*a*.

Figure 2B:
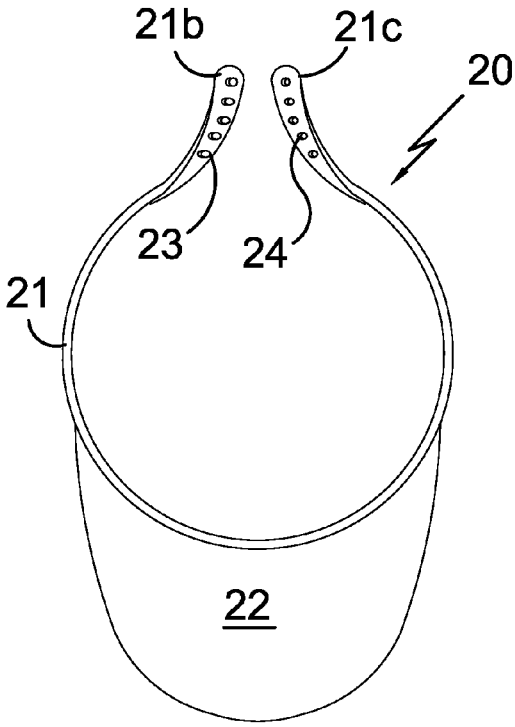
Figure 2C:
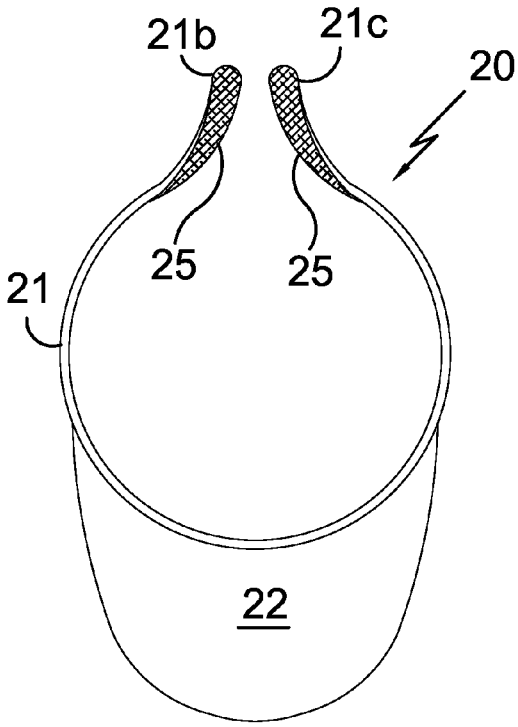

Alternatively, the circumferential band 21 may be made circumferentially adjustable by splitting the band 21 at its rear portion so as to comprise a first free end 21*b* and a second free end 21*c*, for example, as in FIGS. 2*b* and 2*c* wherein the overlapping of the first free end 21*b* with the second free end 21*c*, or vice versa, determines the adjusted size of the circumferential band 21.

To this end, referring to FIGS. 2*b* and 2*c*, the first free end 21*b* and the second free end 21*c* may further comprise plastic strips having corresponding holes 23 and projections 24 to accommodate various sizes by fastening at least one projection 24 into a corresponding hole 23 when the first and second free ends 21*b* and 21*c* are overlapped sufficiently to achieve a desired size. Alternatively, the first free end 21*b* and the second free end 21*c* may further comprise Velcro®, or other hook and loop fastening material, that fasten the first free end 21*b* with the second free end 21*c* when the first and second free ends 21*b* and 21*c* are sufficiently overlapped to achieve the desired size. Of course, the artisan will readily appreciate that orientation of the holes 23 and projections 24, or of the Velcro®, or other hook and loop fastening material, may be inverse than that shown in FIGS. 2*a* and 2*b*.

Figure 3:
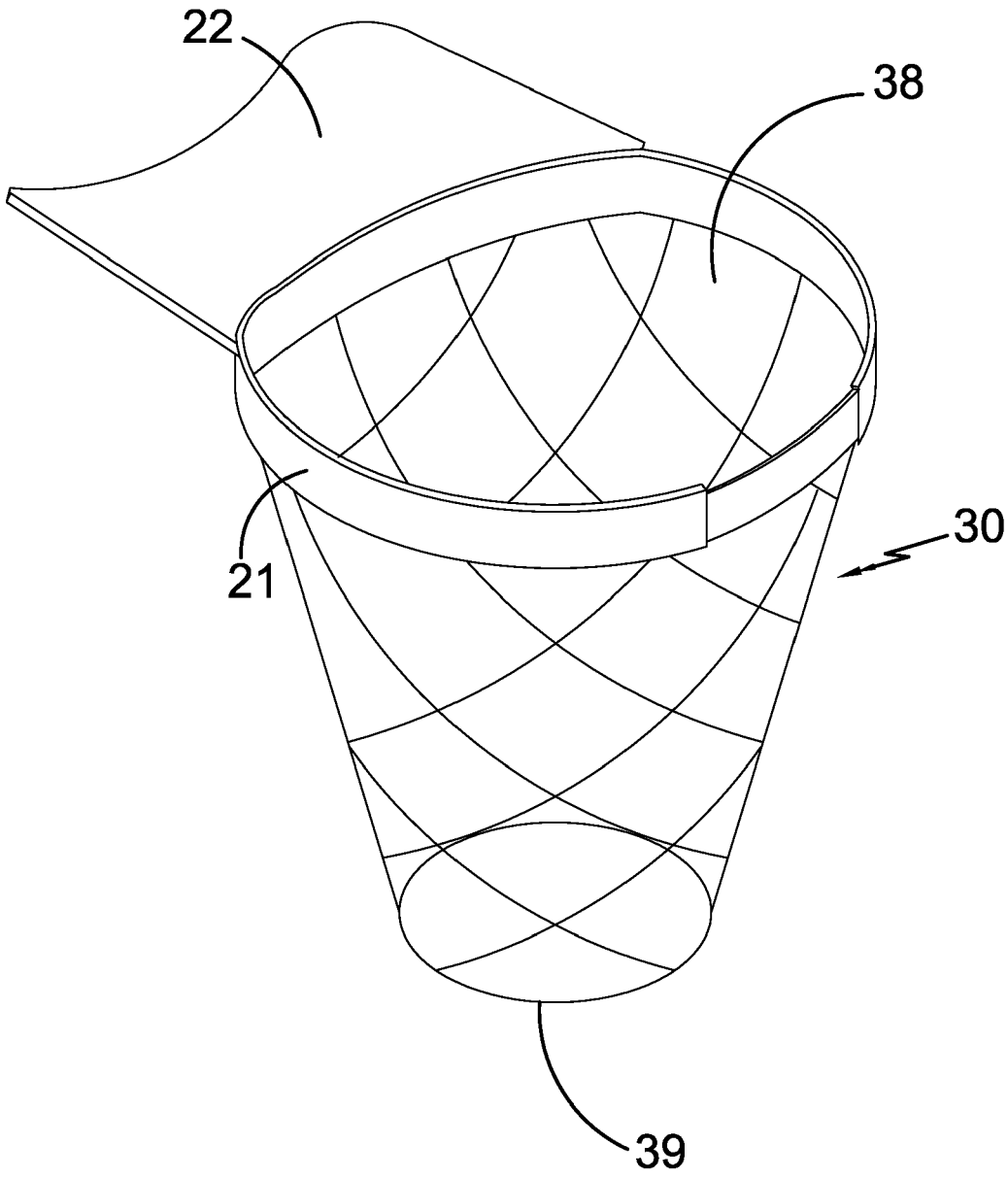
FIG. 3 illustrates the visor portion with a netting or hoop deployed according to various embodiments described herein.

FIG. 3 shows more particularly, the visor portion 20 having a netting secured to the visor portion and the circumferential band, and the netting having openings 38, 39 on opposing ends with the ingress opening 38 diametrically larger than the egress opening 39. In some embodiments, the visor portion 20, with netting 30 secured thereto, is part of the headgear 1 including the crown portion 10. In other embodiments, the crown portion 10 is omitted, whereby the visor portion 20, with netting 30 secured thereto, comprises an independent embodiment of the headgear 1.

Figures 4A, 4B, 4C:
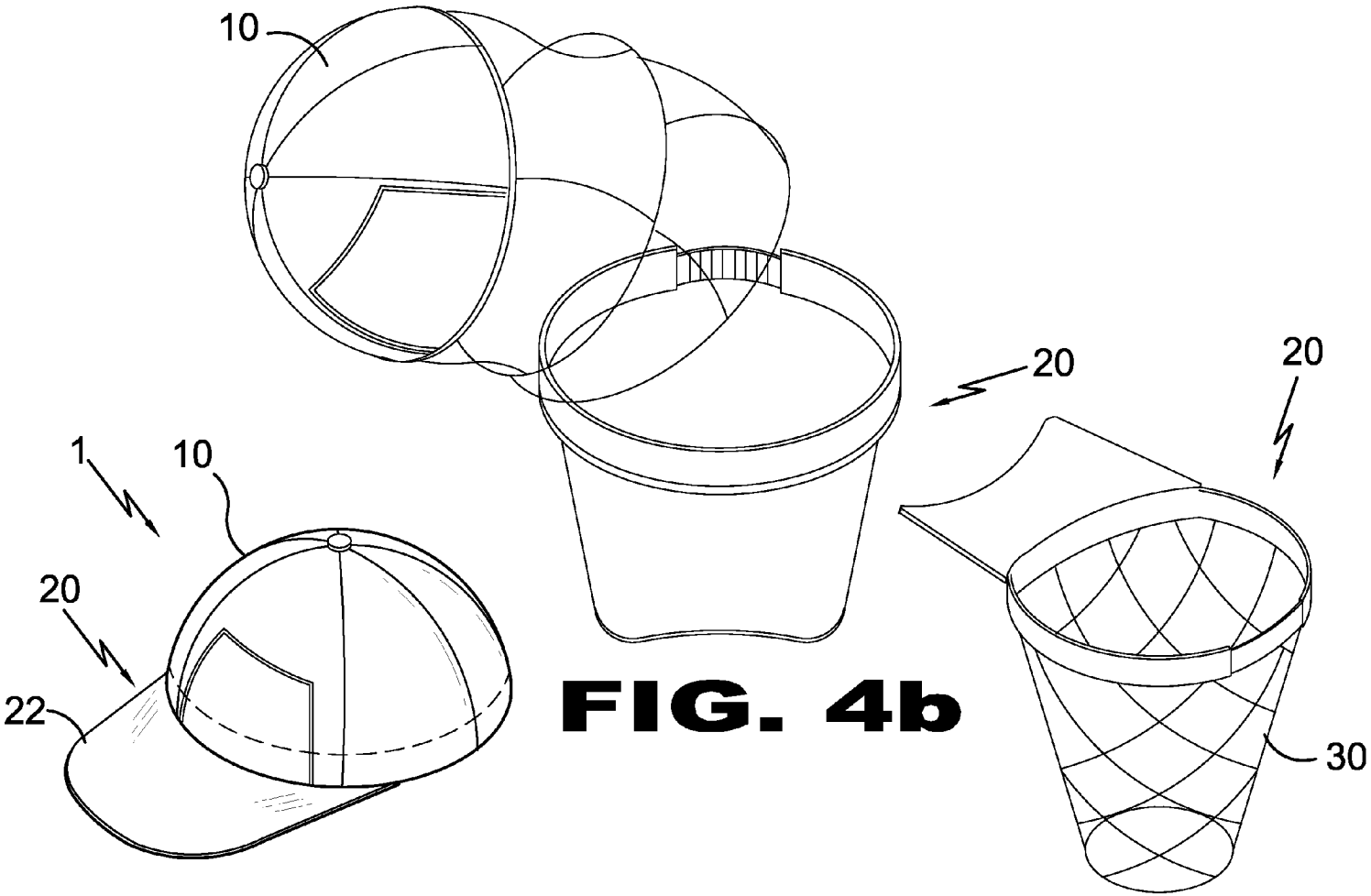
FIGS. 4*a*-4*c* illustrates steps for deploying the netting or hoop in embodiments having a crown portion of the headgear provided for removal from the visor portion thereof.

FIGS. 4*a*-4*c* illustrate steps for deploying the netting 30 in embodiments having a crown portion 10 comprising a portion of the headgear 1, whereby the crown portion 10 must be removed from the visor portion 20 in order to deploy the netting or hoop for playing therewith. FIG. 4*a* illustrates the headgear 1 with the crown portion 10 in place and secured to the visor portion 20. FIG. 4*b* illustrates the crown portion 10 removed from the visor portion 20. FIG. 4*c* illustrates the netting or hoop 30 deployed to extend down from the visor portion 20 after removal of the crown portion 10 has occurred. Of course, in those embodiments where the crown portion 10 is omitted, then the netting or hoop 30 is deployed directly from the visor portion 20, as by removal of the visor portion from one wearing the visor portion, or by appropriate placement of the visor portion 20 to enable the netting or hoop 30 to extend therefrom, as shown in FIG. 4*c*, for example. In any case, once the netting or hoop 30 is deployed, the bill 22 of the visor portion 20 may be secured between a door frame and an edge of the door, or between a drawer frame and an edge of the drawer, for example, to render the netting or hoop 30 available for tossing articles therethrough.

Figure 5A:
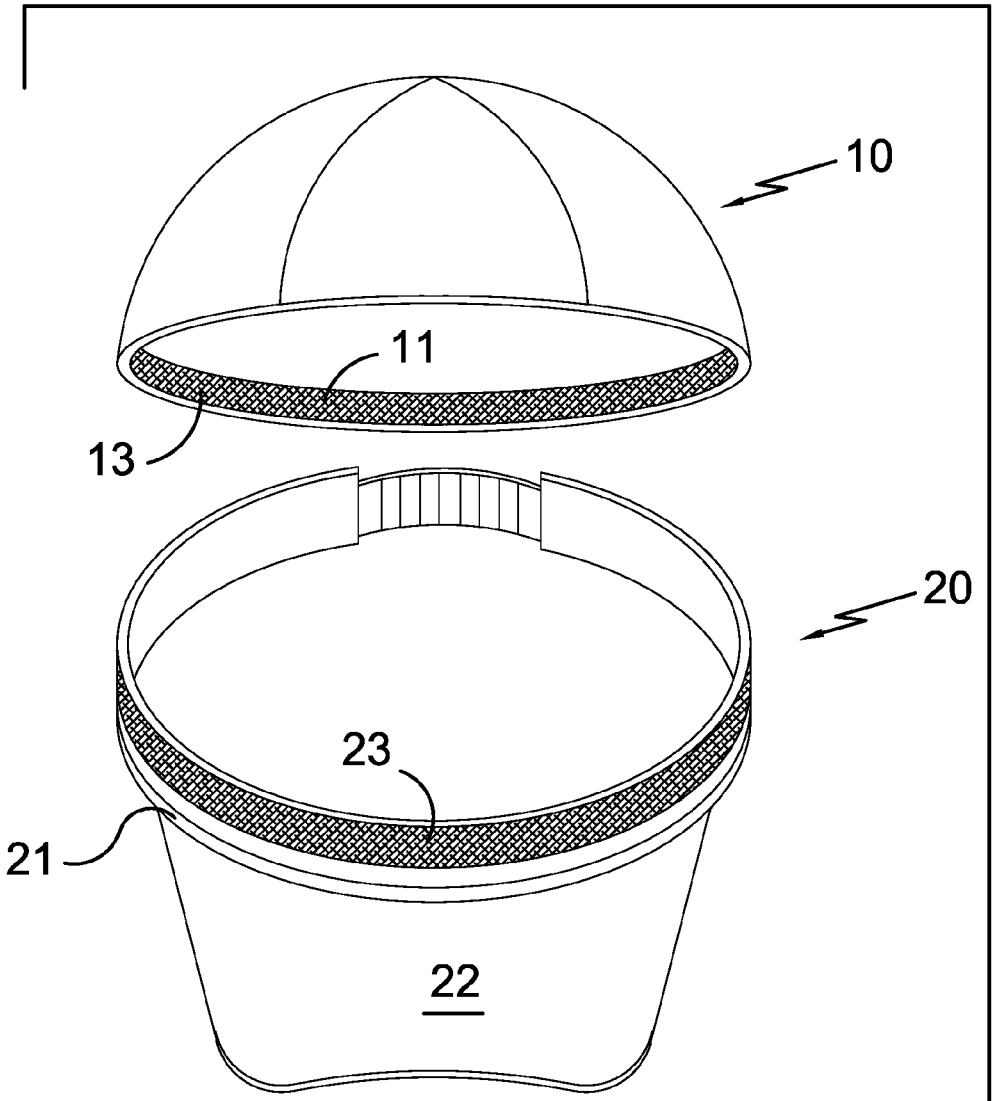
FIGS. 5*a* and 5*b* illustrate the crown portion secured to the visor portion of the headgear using Velcro®, or other hook and loop fastening material, according to various embodiments described herein.
Figure 5B:
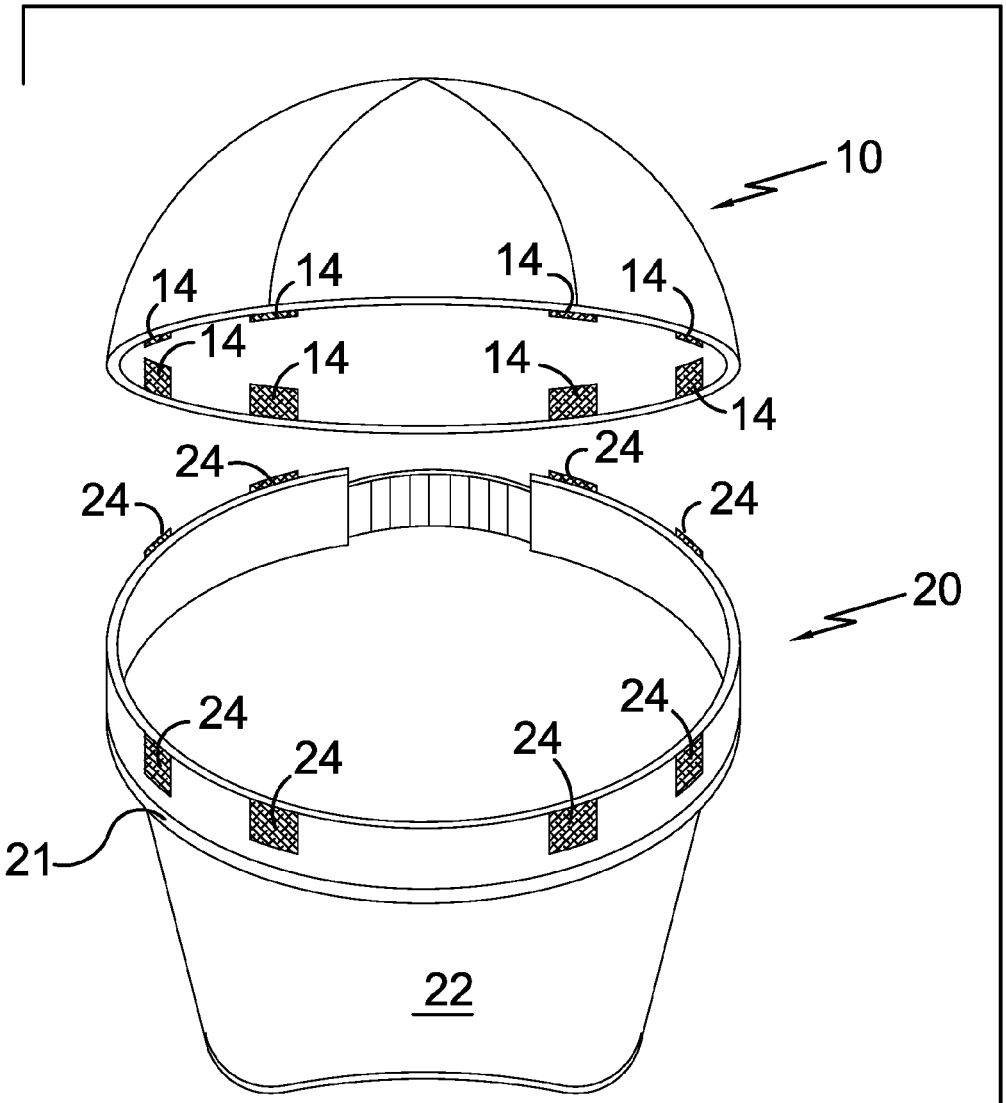

In some embodiments, as shown in FIGS. 5*a* and 5*b*, the crown portion 10 is separably secured to the visor portion 20 using Velcro®, or other hook and loop fastening material. In particular, one side of the Velcro®, or other hook and loop fastening material, is provided on an interior surface of the circumferential band 11 of the crown portion 10, and a mating side of the Velcro®, or other hook and loop fastening material, is provided on an exterior surface of the circumferential band 21 of the visor portion 20. In this manner, when the circumferential band 11 of the crown portion 10 is placed over the circumferential band 21 of the visor portion 20, the Velcro®, or other hook and loop fastening material, provided on the corresponding circumferential bands 11 and 21 secure to one another, thereby securing the crown portion 10 to the visor portion 20. As the artisan will readily appreciate, the Velcro®, or other hook and loop fastening material, may be provided as a continuous band 13 and 23 along the respective circumferential bands 11 and 21 of the crown portion 10 and visor portion 20, as shown in FIG. 5*a* particularly where elastic is used to render either or both of the circumferential bands 11 and 21 adjustable. Alternatively, as the artisan will also appreciate, the Velcro®, or other hook and loop fastening material may be provided in a non-continuous band or at discrete locations 14 and 24 of the interior and exterior surfaces of the respective circumferential bands 11 and 21 of the crown portion 10 and visor portion 20, as shown in FIG. 5*b*, particularly where the circumferential band 21 of the visor portion 20 is separated into free ends 21*b* and 21*c* to render the band 21 adjustable. As described earlier herein, at least one of the circumferential bands 11 and 21 is made circumferentially adjustable, so as to enable adjustment thereof to the size and shape of a wearer of the headgear. Still further alternatively, one or more zippers may be provided in lieu of the Velcro®, or other hook and loop fastening material, as a continuous band or at discrete locations over the respective interior and exterior surfaces of the respective circumferentially adjustable bands 11 and 21 of the crown portion 10 and visor portion 20, respectively, as otherwise shown in FIGS. 5*a* and 5*b* and otherwise described herein, whereby the one or more zippers are stitched into the fabric of the respective circumferentially adjustable bands 11 and 21.

Figure 6:
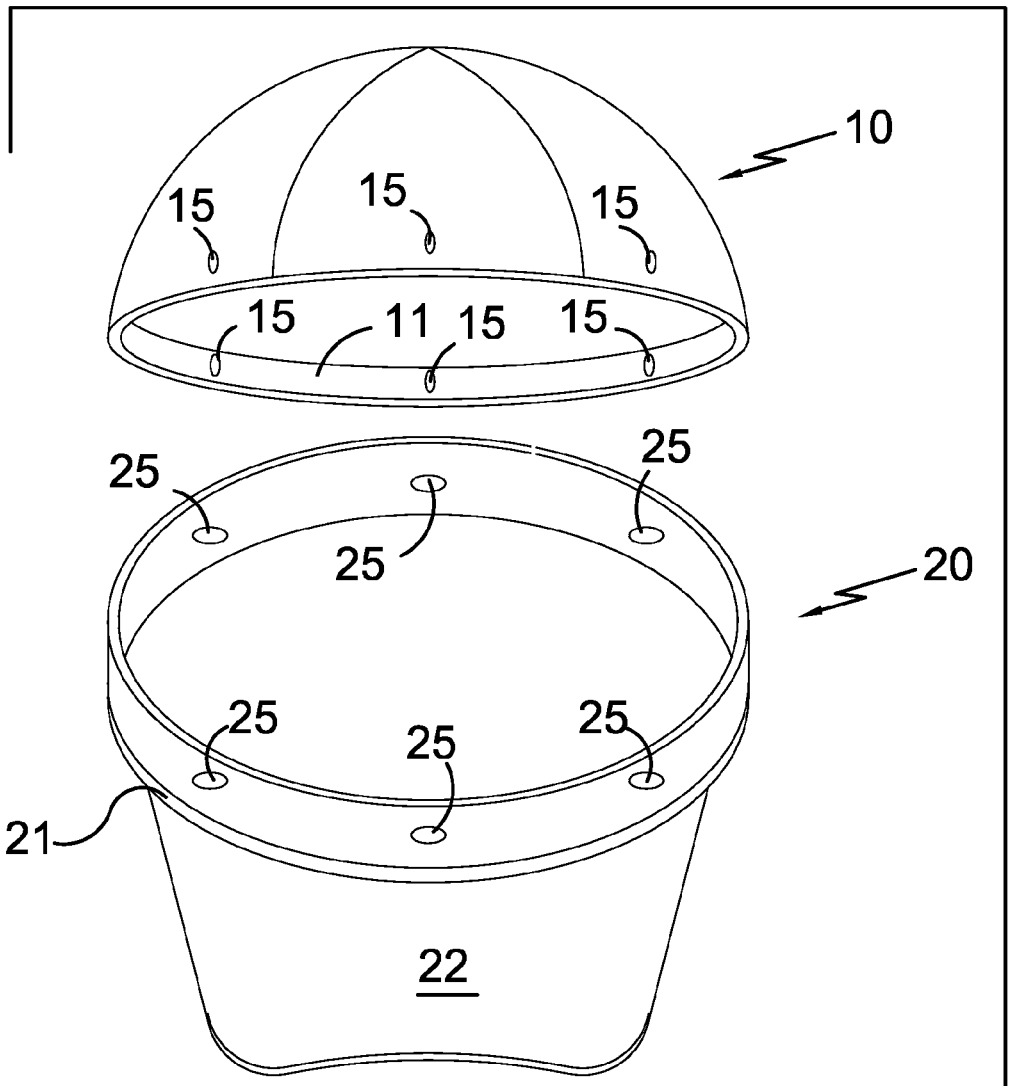
FIG. 6 illustrates the crown portion secured to the visor portion of the headgear using buttons and button receptacles according to various embodiments described herein.

In other embodiments, as shown in FIG. 6, buttons 25 provided on the exterior surface of the circumferential band 21 of the visor portion 20 secure the crown portion 10 thereto by receipt of the buttons 25 through corresponding button receptacles 15 stitched into the circumferential band 11 of the crown portion 10. At least one of the circumferential bands 11 and 21 is made circumferentially adjustable thereby so as to enable adjustment thereof to comply with the size and shape of a wearer of the headgear. The buttons 25 are sewn or secured to the circumferential band 21 in conventional manner. Of course, although not shown, the artisan will readily appreciate that placement of the buttons 25 and corresponding button receptacles 15 may also be inversely oriented such that the buttons 25 are provided on an interior surface of the circumferential band 11 of the crown portion 10, while the button receptacles 15 may be correspondingly stitched into the circumferential band 21 of the visor portion 20. The preferred configuration where buttons are used is as shown in FIG. 6.

Figure 7:
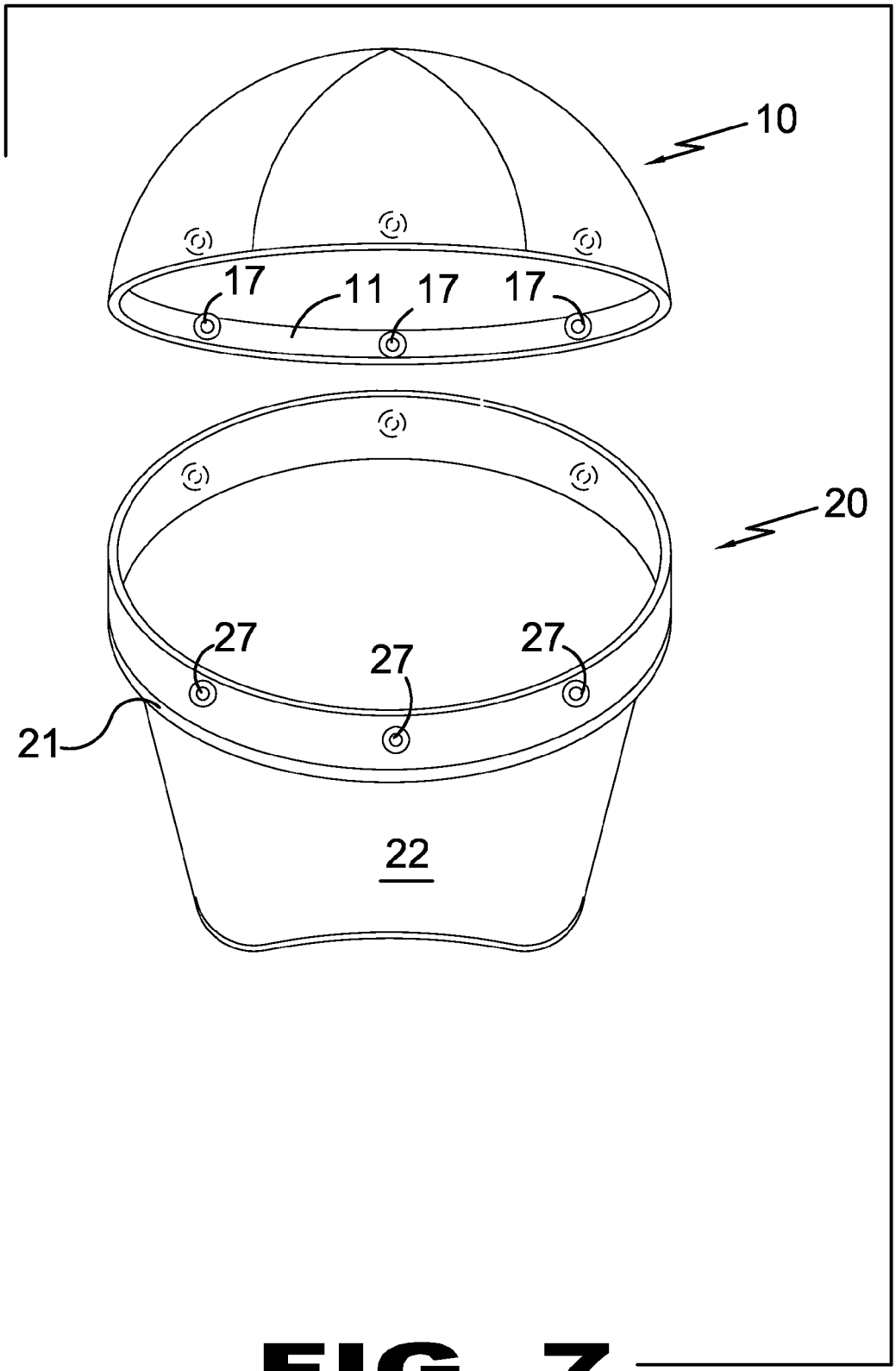
FIG. 7 illustrates the crown portion secured to the visor portion of the headgear using snaps and snap receptacles according to various embodiments described herein.

In still another embodiment, as shown in FIG. 7, snaps 27 provided on the exterior surface of the circumferential band 21 of the visor portion 20 secure the crown portion 10 thereto by receipt of the snaps 27 into corresponding snap receptacles 17 provided on the circumferential band 11 of the crown portion 10. At least one of the circumferential bands 11 and 21 is made circumferentially adjustable thereby so as to enable adjustment thereof to comply with the size and shape of a wearer of the headgear. The snaps 27 and snap receptacles 17 may be sewn, glued, or otherwise secured to the respective circumferential bands 11 and 21 in conventional manner. Of course, the artisan will readily appreciate that the snaps 27 and snap receptacles 17 could be inversely oriented, or a combination thereof, such that some or all of the snaps 27 are provided on the circumferential band 11 of the crown portion 10, while some or all of the snap receptacles 17 are provided on the circumferential band 21 of the visor portion 20.

Another embodiment of the headgear 1 described herein comprises the visor portion 20 with netting or hoop 30 secured thereto, as in FIGS. 3 and 4*c*, without the crown portion 10 secured thereto. As a result, the various attachment means, i.e., Velcro®, other hook and loop material, buttons, snaps or zippers, otherwise described herein for securing the crown portion 10 to the visor portion 20 may be omitted where the visor portion 20 and netting or hoop 30 secured thereto comprise the headgear 1 independently, i.e., to the exclusion of the crown portion 10.

Figure 8:
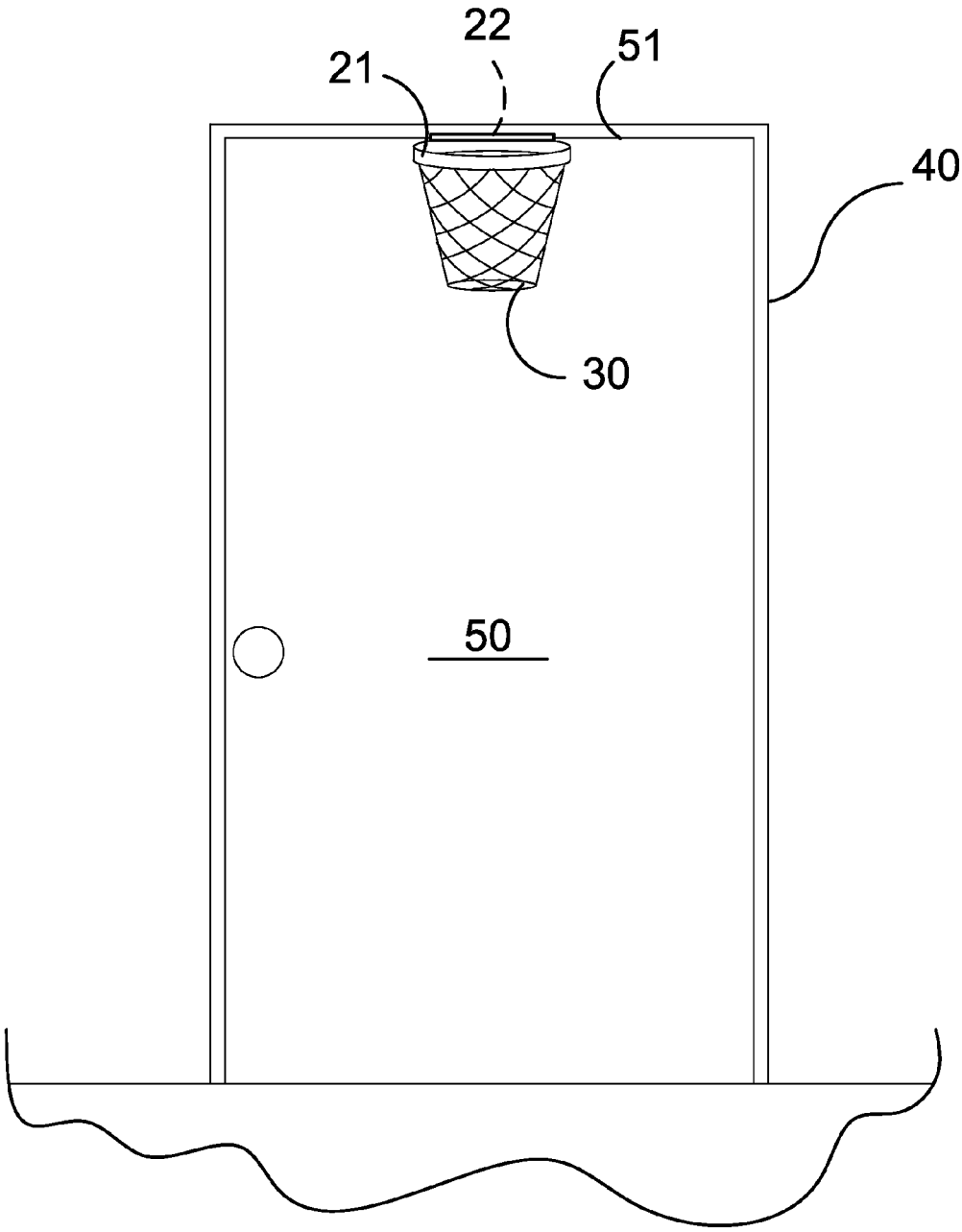
FIG. 8 illustrates the bill of the visor portion fitted between a door or drawer frame and a side of the door or drawer according to various embodiments described herein.

In practice, referring to FIG. 8, when the crown portion 10 of the headgear 1 is secured to the visor portion 20, adjustment of the circumferential band 21 of the visor portion 20 causes a corresponding adjustment of the circumferential band 11 of the crown portion 10 of the headgear 1, when the crown portion 10 is secured thereto. The netting or hoop 30 remains secured to the visor portion 20 and, ideally, is collected and situated within the crown portion 10 of the headgear 1 as the headgear 1 is worn by a person. When the crown portion 10 of the headgear 1 is removed from the visor portion 20, the netting or hoop 30 secured to the visor portion 20 extends to an elongated position, thereby providing the game hoop into which separately provided articles, such as a ball, may be thrown as in a basketball game. The bill 22 of the visor portion 20 of the headgear 1 extends from the circumferentially adjustable band 21 of the visor portion and is configured to fit between a frame 40 of a door 50 and an edge 51 of the door, for example, in order to secure the game hoop in place for playing therewith. Alternatively, the bill 22 of the visor portion 20 may be fitted between the frame of a drawer and an edge of the drawer to secure the game hoop in place for playing therewith. Where the crown portion 10 is omitted, and the visor portion 20 with the netting or hoop 30 secured thereto comprises the headgear 1, then the netting or hoop 30 extends therefrom the visor portion 20 as the bill 22 of the visor portion 20 is fitted between the frame of the door, or drawer, and the edge of the door, or drawer. In any case, the netting or hoop 30 is preferably secured to circumferential band 21 of the visor portion 20 by sewing, buttoning, snapping, touch fastening, or otherwise securing the netting or hoop 30 thereto.

Figure 9A:
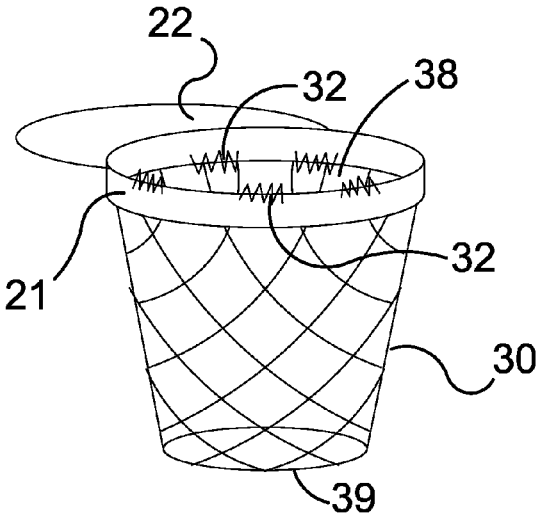
FIGS. 9*a*-9*d* illustrates various means of securing the netting or hoop to the visor portion according to various embodiments described herein.
Figure 9B:
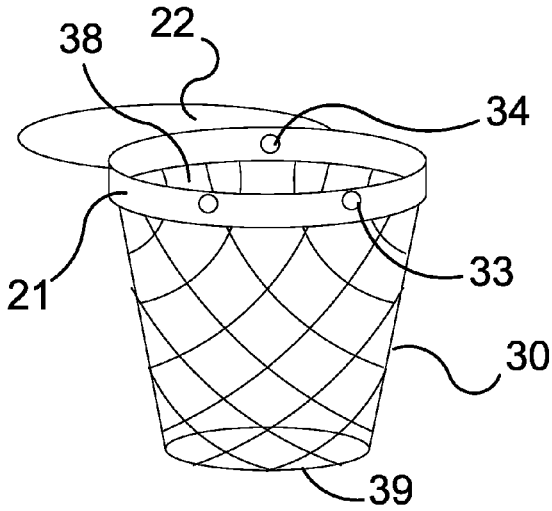
Figure 9C:
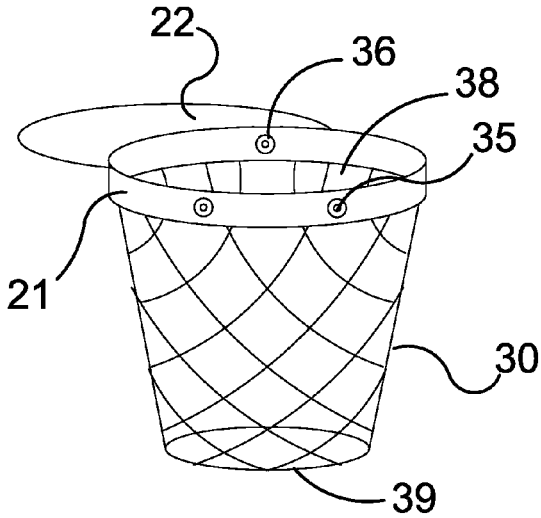
Figure 9D:
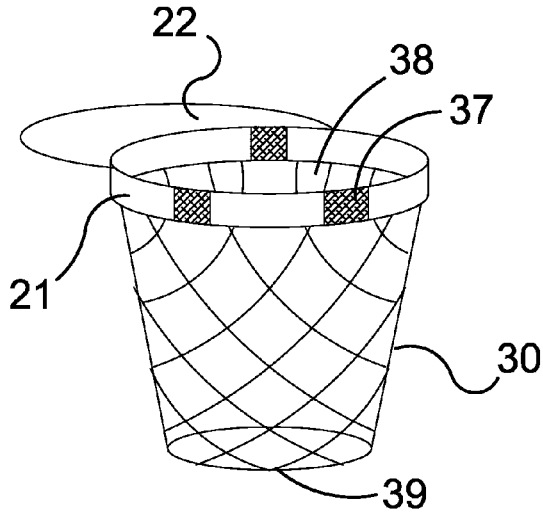

FIGS. 9*a*-9*d* illustrates various techniques of securing the netting or hoop 30 to the visor portion. In particular, FIG. 9*a* shows the netting or hoop 30 sewn to the circumferential band 21 using thread 32. FIG. 9*b* shows the netting or hoop 30 having buttons 33 received into button receptacles 34 (one receptacle 34 shown without button 33 received therein) stitched into the circumferential band 21 of the visor portion 20. FIG. 9*c* illustrates the netting or hoop 30 having snaps 35 received into snap receptacles 36 (one receptacle 36 shown without snap 35 attached thereto) provided on the circumferential band 21 of the visor portion 20, wherein the inverse order of some or all of the snaps 35 and snap receptacles 36 is also contemplated, as the artisan should readily appreciate. FIG. 9*d* illustrates Velcro®, or other hook and loop fastening material, 37 provided on portions of each of the netting or hoop 30 and the circumferential band 21 of the visor portion 20 in order to secure the netting or hoop 30 thereto. Although shown in discrete sections only in FIG. 9*d*, the artisan will readily appreciate that the Velcro®, or other hook and loop fastening material may also be provided as a continuous band about the netting or hoop 30 and the circumferential band 21.

The various exemplary embodiments of the invention as described hereinabove do not limit different embodiments of the present invention, The material described herein is not limited to the materials, designs, or shapes referenced herein for illustrative purposes only, and may comprise various other materials, designs or shapes suitable for the systems and procedures described herein as should be appreciated by one of ordinary skill in the art.

While there has been shown and described what is considered to be preferred embodiments of the invention, it will, of course, be understood that various modifications and changes in form or detail could readily be made without departing from the spirit or scope of the invention. It is therefore intended that the invention be not limited to the exact forms described and illustrated herein, but should be construed to cover all modifications that may fall within the scope of the appended claims.

The invention claimed is:

1. A method of deploying a basketball game hoop, in combination with a headgear, wherein the headgear includes a netting integrated into the headgear, the method comprising the steps of:

a) providing the headgear with a visor with an attached crown, the crown removably attached to the visor so that the crown is completely removable from the visor, the visor including a bill with an attached circumferential band, and the basketball game hoop secured to the circumferential band of the visor, the basketball game hoop comprising the circumferential band of the visor with the downwardly extending netting having an ingress opening larger than an egress opening for passage therethrough of an official sized basketball;

wherein the ingress opening is attached directly to the circumferential band of the visor;

b) removing and separating the crown from the visor;

c) extending the basketball game hoop including the netting from the visor; and d) securing the bill of the visor between a door and door frame to support said visor, and deploying the basketball game hoop for throwing the official sized basketball hoop through the basketball game hoop;

wherein when the basketball game hoop is deployed, the netting extends downward such that the ingress opening is situated above the egress opening, and when the official sized basketball is thrown through the circumferential band, the official sized basketball passes through the ingress and egress openings.

2. The method of claim 1, wherein circumferential band is circumferentially adjustable with free ends having mating fastening material for adjusting a diameter of the circumferential band.

3. The headgear of claim 2, wherein the mating fastening material is selected from the group consisting of hook and loop fastening material, buttons and corresponding button receptacles, and snaps and corresponding snap receptacles.

4. The method of claim 1, providing the crown with a circumferential band that fits over the circumferential band of the visor when the crown is secured to the visor.

5. The method of claim 1, providing the basketball game hoop and the circumferential band of the visor with mating fasteners so that the basketball game hoop is removably attached to the circumferential band of the visor.

* * * * *